US007037066B2

(12) United States Patent
Moss

(10) Patent No.: US 7,037,066 B2
(45) Date of Patent: May 2, 2006

(54) TURBINE FUEL PUMP IMPELLER

(75) Inventor: Glenn A. Moss, Cass City, MI (US)

(73) Assignee: TI Group Automotive Systems, L.L.C., Warren, MI (US)

( * ) Notice: Subject to any disclaimer, the term of this patent is extended or adjusted under 35 U.S.C. 154(b) by 209 days.

(21) Appl. No.: 10/458,426

(22) Filed: Jun. 10, 2003

(65) Prior Publication Data

US 2003/0231952 A1 Dec. 18, 2003

Related U.S. Application Data

(60) Provisional application No. 60/389,607, filed on Jun. 18, 2002.

(51) Int. Cl.
*F04D 5/00* (2006.01)

(52) U.S. Cl. ..... 415/55.1; 415/55.4

(58) Field of Classification Search ..... 415/55.7, 415/55.6, 55.5, 55.4, 55.3, 55.2, 55.1
See application file for complete search history.

(56) References Cited

U.S. PATENT DOCUMENTS

| | | | | |
|---|---|---|---|---|
| 751,209 | A | 2/1904 | Shwarze | |
| 945,742 | A | 1/1910 | Boeckel et al. | |
| 1,340,091 | A | 5/1920 | Trane | |
| 1,689,579 | A | 10/1928 | Burks | |
| 2,042,499 | A | 6/1936 | Brady | |
| 3,951,567 | A | 4/1976 | Rohs | |
| 3,973,865 | A | 8/1976 | Mugele | |
| 4,141,674 | A | 2/1979 | Schonwald | |
| 4,556,363 | A | 12/1985 | Watanabe et al. | |
| 4,678,395 | A * | 7/1987 | Schweinfurter | 415/55.6 |
| 4,923,365 | A * | 5/1990 | Rollwage | 415/119 |
| 5,141,396 | A | 8/1992 | Schmidt et al. | |
| 5,257,916 | A | 11/1993 | Tuckey | |
| 5,299,908 | A | 4/1994 | Robbie | |
| 5,328,325 | A | 7/1994 | Strohl | |
| 5,372,475 | A | 12/1994 | Kato et al. | |
| 5,395,210 | A | 3/1995 | Yamazaki et al. | |
| 5,527,149 | A | 6/1996 | Moss | |
| 5,536,139 | A | 7/1996 | Yamazaki et al. | |
| 5,596,970 | A | 1/1997 | Schoenberg et al. | |
| 5,642,981 | A | 7/1997 | Kato | |
| 5,702,229 | A | 12/1997 | Moss | |
| 5,762,469 | A | 6/1998 | Yu | |
| 5,807,068 | A | 9/1998 | Dobler | |
| 6,068,456 | A | 5/2000 | Tuckey | |
| 6,102,653 | A | 8/2000 | Marx | |
| 6,113,363 | A | 9/2000 | Talaski | |

(Continued)

*Primary Examiner*—Hoang Nguyen
(74) *Attorney, Agent, or Firm*—Reising, Ethington, Barnes, Kisselle, P.C.

(57) ABSTRACT

A multiple-channel, single stage, turbine fuel pump impeller, preferably for use with vehicle fuel delivery systems. The impeller includes independent inner and outer vane arrays concentrically disposed to one another and radially spaced apart. The inner and outer vane arrays respectively communicate with independent inner and outer pumping chambers, each of which receives fuel at an inlet end from a common fuel inlet passage and expels fuel at an outlet end into a common fuel outlet passage. Furthermore, the pumping efficiency and overall performance of the pump is increased by utilizing an impeller where each vane: i) includes a linear root segment and a curved tip segment, ii) has a V-shape that opens in the direction of rotation, and iii) includes a rounded surface or radius on a trailing edge, to name but a few of the attributes of the vanes.

72 Claims, 7 Drawing Sheets

U.S. PATENT DOCUMENTS 6,132,185 A 10/2000 Wilhelm
6,152,687 A 11/2000 Wilhelm
6,152,688 A 11/2000 Staab et al.
6,162,012 A 12/2000 Tuckey et al.
6,227,819 B1 5/2001 Gettel
6,231,300 B1 5/2001 Wilhelm et al.
6,231,318 B1 5/2001 Cotton et al.
6,302,639 B1 10/2001 Endler et al.
6,309,173 B1 10/2001 Marx
6,402,460 B1 6/2002 Fischer
6,422,808 B1 7/2002 Moss et al.
6,425,734 B1 7/2002 Marx
6,435,810 B1 8/2002 Fischer
6,439,833 B1 8/2002 Pickelman
6,443,691 B1 9/2002 Nather
6,443,693 B1 9/2002 Eck
6,447,242 B1 9/2002 Wilhelm
6,454,520 B1 9/2002 Pickelman
6,454,521 B1 9/2002 Anderson et al.
6,464,450 B1 * 10/2002 Fischer ..... 415/55.1
6,471,466 B1 10/2002 Marx
6,481,958 B1 11/2002 Wilhelm
6,497,552 B1 12/2002 Kobayashi
6,499,941 B1 12/2002 Fischer
6,503,049 B1 1/2003 Marx
6,517,310 B1 2/2003 Marx
6,527,506 B1 3/2003 Pickelman
6,533,538 B1 3/2003 Aslam
6,540,474 B1 4/2003 Marx et al.
2002/0021961 A1 2/2002 Pickelman
2002/0141860 A1 10/2002 Kusagaya et al.
2002/0168261 A1 11/2002 Honma

* cited by examiner

TURBINE FUEL PUMP IMPELLER

REFERENCE TO RELATED APPLICATION

Applicant claims the benefit of U.S. Provisional Application No. 60/389,607, filed Jun. 18, 2002.

TECHNICAL FIELD

This invention relates generally to a turbine fluid pump, and more particularly, to an impeller for a turbine fuel pump for use in a vehicle fuel delivery system.

BACKGROUND OF THE INVENTION

Electric motor driven turbine fluid pumps are customarily used in fuel systems of an automotive vehicle and the like. These pumps typically include an external sleeve which surrounds and holds together an internal housing adapted to be submerged in a fuel supply tank with an inlet for drawing liquid fuel from the surrounding tank and an outlet for supplying fuel under pressure to the combustion engine. A downward projecting shaft of the electric motor concentrically couples to and drives a disk-shaped pump impeller having an array of circumferentially spaced vanes disposed about the periphery of the impeller. An arcuate pumping channel carried by the housing substantially surrounds the impeller periphery and extends from an inlet port and to an outlet port at opposite ends. Liquid fuel disposed in pockets defined between adjacent impeller vanes and the surrounding channel develops pressure through a vortex-like action induced by the three dimensional profile of the vanes and the rotation of the impeller.

The vanes of disk-shaped turbine pump impellers have a wide variety of three-dimensional profiles or shapes. This shape is dependent upon the type of disk impeller utilized and the surrounding housing of the pump. For example, fuel pump impeller vanes are known to be generally flat, straight and radially outwardly extending. Other impeller vanes are known to be flat, straight and canted relative to a radius of the impeller. Yet other vane designs, such as that described in U.S. Pat. No. 6,113,363 which issued to Talaski on Sep. 5, 2000 and is incorporated herein by reference, have vanes which are inclined such that the tip trails the base as the impeller rotates and are generally arcuate along both their axial and radial extent.

There are generally two types of disk-shaped turbine pump impellers which can dictate the profile of an impeller vane. They are generally referred to as a guide ring-type and a hoop-type.

A guide ring-type impeller configuration is utilized in conjunction with a stationary guide ring firmly mounted to the housing of the pump. The guide ring functions to divert the fuel flow from a vertical inlet port, guides the fuel through a substantially horizontal arcuate or annular channel, then strips the fuel from the moving impeller vanes within the annular channel and diverts the fuel to a substantially vertical outlet port. The arcuate channel extends about the periphery of the guide ring-type impeller, between the inlet and outlet ports by about 270 to 330 degrees, and is defined radially outwardly by the guide ring and radially inwardly by the periphery of the impeller. The vanes, such as those described in the '363 patent, have free ends or tips which project substantially radially outward from the impeller and laterally into the channel. A stripper portion of the guide ring is diametrically opposed to the channel and orientated circumferentially between the inlet and outlet ports. As the impeller rotates, the moving tips of the vanes brush closely to the stripper portion of the guide to strip the pressurized fuel from the impeller and divert it from the channel to the outlet port. The stripper portion must maintain its closed orientation to the tips of the vanes to prevent bypass of pressurized fuel from the outlet port to the low pressure inlet port. This stripping relationship between the guide ring and free-ends or tips of the impeller vanes requires expensive precision in manufacturing, can wear over time degrading the efficiency of the pump, and requires extra parts which may further increase the cost of manufacturing and maintenance.

A hoop-type impeller, such as that illustrated in U.S. patent application Publication No. U.S. 2002/0021961 A1 published Feb. 21, 2002 and issued to Pickelman et al., and in U.S. Pat. No. 5,807,068 (FIGS. 6 and 7) issued Sep. 15, 1998 to Dobler et al., both of which are incorporated herein by reference, does not utilize a guide ring but instead has a peripheral hoop as a unitary part of the impeller. The hoop is engaged to and supported by the radially outward ends of the circumferential array of impeller vanes. Impeller pockets defined circumferentially between the adjacent vanes communicate only laterally outward from the impeller into upper and lower grooves of the channel defined by the pump housing. In designs with an impeller hoop, communication between the impeller pockets and the channel, is solely axial, or side-flanking. Unfortunately, the known three-dimensional vane profiles for the hoop-type impeller are limited and overall pump efficiencies are relatively low.

Known turbine fuel pumps have an overall efficiency of approximately 35–45%, and when combined with an electric motor having a 45–50% efficiency, the overall efficiency of such electric motor turbine fuel pumps is between about 16–22%. Moreover, higher flow and pressure requirements for automotive vehicle fuel pumps are exceeding the capabilities of conventional 36–39 mm diameter regenerative turbine pumps. To increase fuel output and pressure, pumps must operate at higher speeds. However, this may result in cavitation, which continues to be a challenge. Thus, there is a continuing need to improve the design and construction of such fuel pump impellers to increase their efficiency.

SUMMARY OF THE INVENTION

The above-noted shortcomings of prior art fluid pumps are overcome by the turbine fluid pump impeller of the present invention, which, according to one embodiment, generally includes a circular hub, a ring-shaped hoop and a ring-shaped vane array. The hub includes an outer hub surface that generally extends around its outer circumference, the hoop includes an inner hoop surface that generally extends around its inner circumference, and the vane array includes a plurality of vanes and vane pockets that are generally formed in between the vanes. Each of the vanes includes i) a linear root segment that extends in a first direction and ii) a curved tip segment, where a line tangent to the curved tip segment extends in a second direction. The first direction is retarded with respect to the second direction, when considered in the rotational direction of the impeller.

According to another embodiment, there is provided a turbine fluid pump impeller that also includes a circular hub, a ring-shaped hoop and a ring-shaped vane array. However, each of the vanes of this vane array generally include: i) upper and lower halves generally arranged in a V-shape configuration, ii) a root segment that extends in a first general direction, and iii) a tip segment that generally extends in a second direction. The point at which the tip segment joins an inner hoop surface trails the point at which the root segment joins an outer hub surface, when considered in the rotational direction of the impeller.

According to yet another embodiment, there is provided a single-stage, multiple vane array fluid pump impeller that includes a circular hub, a ring-shaped inner vane array, a ring-shaped mid hoop, a ring-shaped outer vane array, and a ring-shaped outer hoop. The hub and the mid hoop each includes a circumferentially extending ridge. The hub, inner vane array, mid hoop, outer vane array and outer hoop are all generally concentric, with the inner vane array being located at a radial position between the hub and the mid hoop and the outer vane array being located at a radial position between the mid hoop and the outer hoop. Each of the hub and mid hoop ridges radially extends a partial distance into an adjacent vane pocket, thus forming upper and lower vane pocket portions such that fluid within one of the vane pocket portions may communicate with the other vane pocket portion without leaving that vane pocket.

According to yet another embodiment, there is provided a turbine fuel pump assembly for use with a vehicle fuel delivery system that includes the impeller of the present invention.

Objects, features and advantages of this invention include providing a turbine fluid pump impeller for use in a pump that has an improved pumping efficiency, that has an increased displacement without requiring additional components, that has an improved hot fuel performance, that is easier to manufacture than multi-stage pumps, that has a flat performance curve through various pressures and voltages, and that is designed such that multiple stages can be added without significant cost or complexity, to name but a few. Furthermore, the present design is relatively simple and economical to manufacture, and has a significantly increased useful life in service.

BRIEF DESCRIPTION OF THE DRAWINGS

These and other objects, features and advantages of the present invention will be apparent from the following detailed description of the preferred embodiments, appended claims and accompanying drawings, in which:

FIG. 1 is a partial perspective view of the impeller shown in FIG. 7 looking radially inward with portions removed to show internal detail of a leading surface of the vanes;

DETAILED DESCRIPTION OF THE EMBODIMENT

Figure 1:
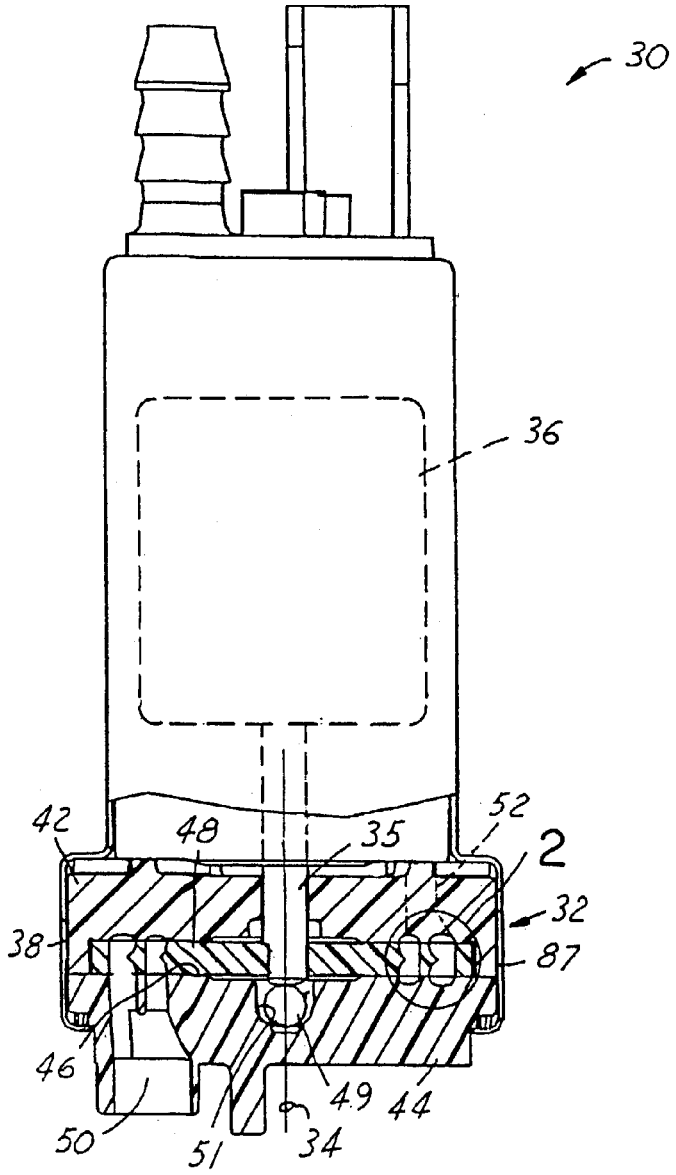
FIG. 1 is a partial cross-sectional view of an example of a turbine fuel pump assembly that may utilize the impeller of the present invention.

FIG. 1 illustrates an example of a turbine fuel pump assembly 30 utilizing an impeller of the present invention, where the impeller is preferably powered or rotated on an axis of rotation 34 by an electric motor 36. Pump assembly 30 can be applied to any number of a variety of fluid pumping applications but preferably, and for purposes of description, is utilized in an automotive fuel delivery system where the pump assembly is typically mounted in a fuel tank of a vehicle having an internal combustion engine, not shown. An outer housing or sleeve 38 of the pump assembly 30 supports the electric motor 36 and a pumping section 32 in an upright position. In use, the axis of rotation 34 extends in a substantially vertical orientation, with respect to the pumping section 32 which is disposed below the motor 36.

The pumping section 32 includes an upper casing 42 and a lower casing 44, which are held together externally and generally encircled by the outer housing 38. An impeller cavity 46 is defined between, as well as being disposed substantially concentric to, the upper and lower casings 42, 44, and carries an impeller 48 of the present invention which rotates about the axis 34. A rotor (not shown), an integral shaft 35 of the motor, and impeller 48 all co-rotate about the axis of rotation 34. The shaft 35 projects downward through the upper casing 42, is fixedly coupled to and projects through the impeller 48, and bears against a bearing 49 that is located in a blind bore 51 in the lower casing.

A fuel inlet passage 50 communicates through the lower casing 44 in a substantially axial direction, through which low pressure fuel flows upward from a fluid reservoir or surrounding fuel tank (not shown) to the impeller cavity 46. Similarly, the upper casing 42 carries a fuel outlet passage 52 (shown in phantom), which provides a passage for pressurized fuel to flow in an axially upward direction out of the cavity 46. Inner and outer circumferential vane arrays 56A, 56B of impeller 48 respectively propel the fuel through circumferentially extending inner and outer pumping chambers 54A, 54B, which are primarily deposed between upper and lower casings 42, 44. The inner and outer vane arrays 56A, 56B are radially aligned with the inner and outer pumping chambers 54A, 54B, respectively, which, as better seen in FIG. 3, generally extend for an angular extent of about 300–350°, or in any case, less than 360°. The pumping chambers 54A and 54B extend about the rotational axis 34 from the inlet passage 50 to the outlet passage 52 (not shown in FIG. 3). There is generally no, or only a limited amount, of cross fluid communication between the inner and outer pumping chambers 54A, 54B. Very limited cross fluid communication between pumping chambers may be desirable where fuel is needed to act as a lubricant between the moving surfaces.

Figure 2:
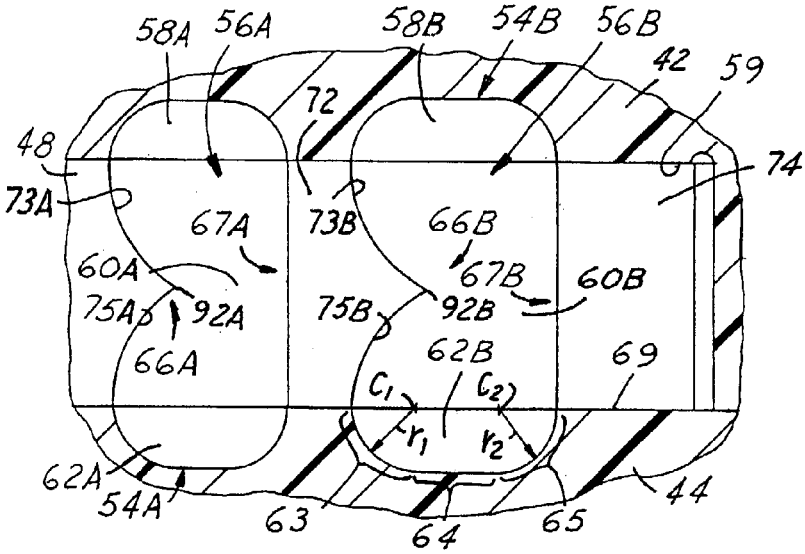
FIG. 2 is a partial enlarged view of the inner and outer pumping chambers shown in FIG. 1.

With specific reference now to FIG. 2, the inner and outer pumping chambers 54A and 54B respectively include upper grooves 58A, 58B, each of which is formed in a bottom surface 59 of the upper casing 42, lower grooves 62A, 62B, each of which is formed in a top surface 69 of the lower casing 44, and vane pockets 60A, 60B which are formed between vanes on the impeller such that they are in fluid communication with both the upper and lower grooves. Stated differently, the circumferentially extending inner pumping chamber 54A includes upper groove 58A formed in upper casing 42, vane pocket 60A formed within impeller 48, and lower groove 62A formed in lower casing 44; all of which are in-fluid communication with each other and are radially aligned such that they circumferentially extend together. In this particular example, upper and lower grooves 58A and 62A are symmetrically shaped and sized, however, they could be non-symmetrically designed as well. The foregoing description of the inner pumping chamber 54A equivalently applies to the outer pumping chamber 54B, which includes upper groove 58B, vane pocket 60B, and lower groove 62B, and is located at a position that is radially outward of the inner pumping chamber. The outer pumping chamber 54B shown in FIG. 2 has a cross-sectional shape that is larger than that of the inner pumping chamber 54A; the unequal size of the two pumping chambers allows for a more efficient impeller. This is because the inner pumping chamber 54A operates at a lower tangential velocity and a higher pressure coefficient than the outer pumping chamber 54B (due to the smaller radius and the shorter circumferential length of the inner pumping chamber). In order to reduce leakage or backflow in the inner chamber, as well as to maximize output flow, the inner pumping chamber 54A requires a smaller cross-sectional area when compared to the outer pumping chamber 54B, both of which are operating at the same rotational speed. There is a trade off, however, between reducing the area of the inner pumping chamber to minimize leakage and maximizing the output flow of that chamber.

The upper and lower grooves 58A, 58B and 62A, 62B are concentric, arcuate grooves that each circumferentially extend around a surface of the upper and lower casings, respectively, such that they open into the impeller cavity 46. Each of these grooves preferably has an oval or elliptical cross-sectional shape, as opposed to a semi-circular cross sectional shape, as commonly seen on prior art pumps. For purposes of clarity, the following description of the shape of the grooves will be provided with specific reference to one of the grooves, but equally applies to the remaining grooves as well. The oval cross-sectional shape of the grooves is comprised of a first radial section 63, a linear or flat section 64, and a second radial section 65, and can increase the efficiency of the pump by reducing the effect of dead or stagnate zones in the pumping chambers where fuel stalls and does not adequately flow. This phenomenon sometimes occurs in semi-circular cross sectional grooves where the groove is too deep, which causes fuel to collect and sit at the bottom of the groove instead of circulating with the rest of the fuel flowing through the pumping chamber. The two radial sections 63, 65 are semi-circular portions of the groove, and may have radii (designating $r_1$ and $r_2$) of a common length or they may have radii with differing lengths. Likewise, the length of the flat section may be uniform amongst the different grooves, or its length may vary with respect to the length of the individual radial sections. In a preferred embodiment, the flat section 64 has a length of between 0.25 mm–1.00 mm. Due to the intervening flat section 64, center points $C_1$ and $C_2$, which correspond to radii $r_1$ and $r_2$, are separated by a certain distance. This distance may vary to suit the particular performance needs of the pump, and can be a function of one of the other dimensions of the grooves. For instance, either the length of flat section 64 or the distance separating the center points may be defined as a function of the length of $r_1$ and/or $r_2$. The upper and lower grooves 58A, 58B and 62A, 62B, which are stationary during operation as they are formed in the upper and lower casings 42, 44, interact with the circulating vane pockets, which will now be described in greater detail.

The vane pockets 60A and 60B are part of the impeller 48 and are formed between adjacent vanes in the inner and outer vane arrays 56A and 56B, respectively. Both the inner and outer vane pockets are open on both their upper and lower axial ends, such that they are adjacent surfaces 59, 69 and are in fluid communication with the upper and lower grooves. Furthermore, the inner vane pocket includes a surface 66A and the outer vane pocket includes a surface 66B, each of which is located on a radially inward side of the vane pocket and includes a circumferential ridge or rib 92A, 92B, respectively. Each of the vane pockets also includes a surface 67A, 67B that is located on the radially outward side of the vane pocket and is flat. Surfaces 66A and 66B are each partially partitioned by the ridges 92A, 92B such that curved surfaces 73A, 73B are formed on the upper axial halves of surfaces 66A and 66B, and curved surfaces 75A, 75B are formed on the lower axial halves of surfaces 66A and 66B. It follows, that the inner pumping chamber 54A includes a vane pocket 60A having a radially inward surface 66A with a ridge 92A. That ridge partitions surface 66A such that upper and lower curved surfaces 73A and 75A are formed. These curved surfaces may be semi-circular in shape and preferably have a radius equal to that of the first radial section 63 of the corresponding groove. Accordingly, each curved surface 73A, 75A extends away from the ridge 92A in an axial direction towards the upper and lower grooves, respectively, and continues across the small gap separating the grooves from the vane pocket. This continuation causes the curved surfaces 73A and 75A to effectively join with the first radial sections 63 of the grooves 58A and 62A, respectively, thus forming a larger, combined semi-circle that extends from the ridge to the flat section 64. Of course, other pumping chamber arrangements could also be used, such as where the grooves are longer in the radial dimension than are the corresponding vane pockets, etc.

Figure 3:
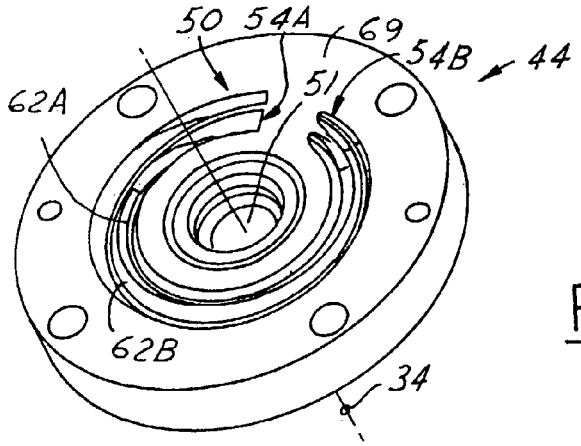
FIG. 3 is a perspective view of the lower casing of the turbine fuel pump assembly shown in FIG. 1.
Figure 4:
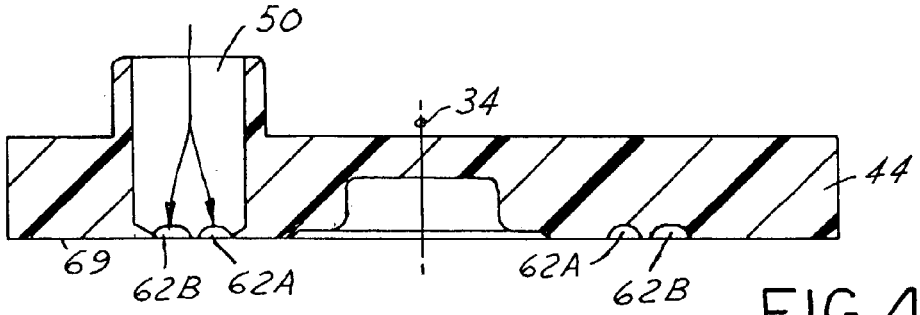
FIG. 4 is an enlarged cross-sectional view of the lower casing of the turbine fuel pump assembly shown in FIG. 1.
Figure 5:
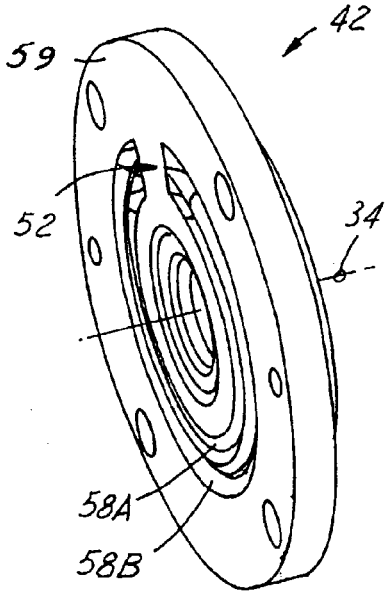
FIG. 5 is a perspective view of the upper casing of the turbine fuel pump assembly shown in FIG. 1.
Figure 6:
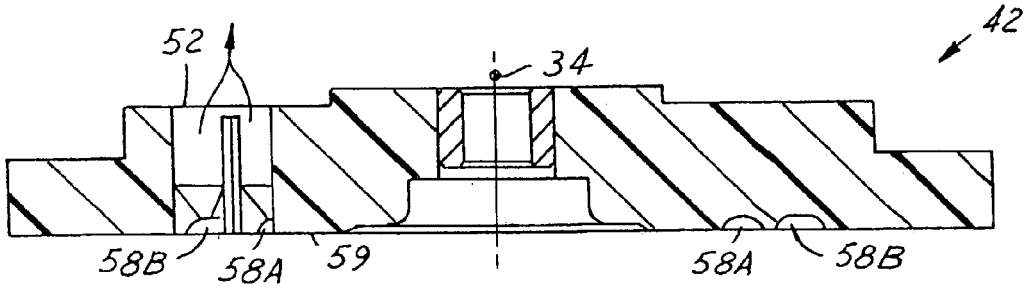
FIG. 6 is an enlarged cross-sectional view of the upper casing of the turbine fuel pump assembly shown in FIG. 1.

FIGS. 3–4 show two perspectives of the lower casing 44, including perspectives where inner and outer lower grooves 62A and 62B are seen formed on the lower casing surface 69. Similarly, FIGS. 5–6 show two perspectives of the upper casing 42; these perspectives include views showing the inner and outer upper grooves 58A and 58B formed on the upper casing surface 59.

Figure 7:
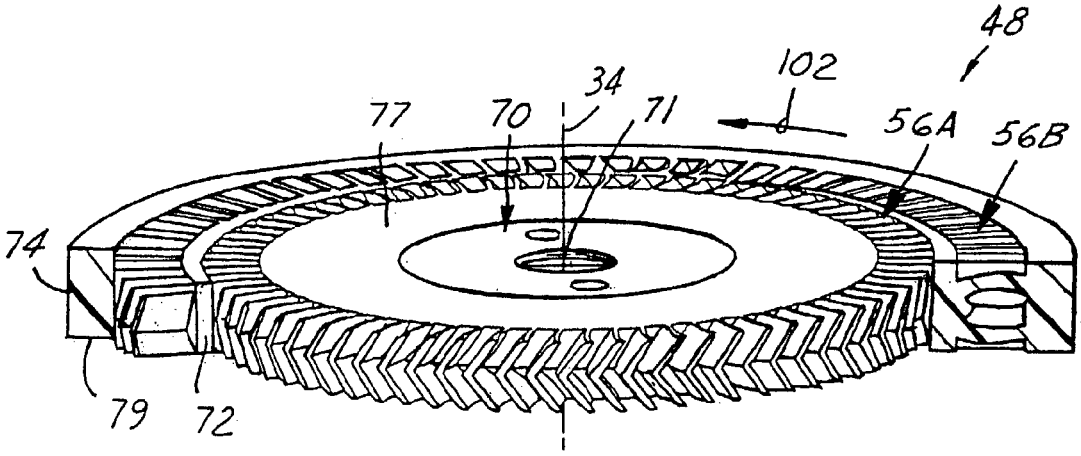
FIG. 7 is a perspective view of an embodiment of the impeller of the present invention with portions removed to show internal detail.
Figure 8:
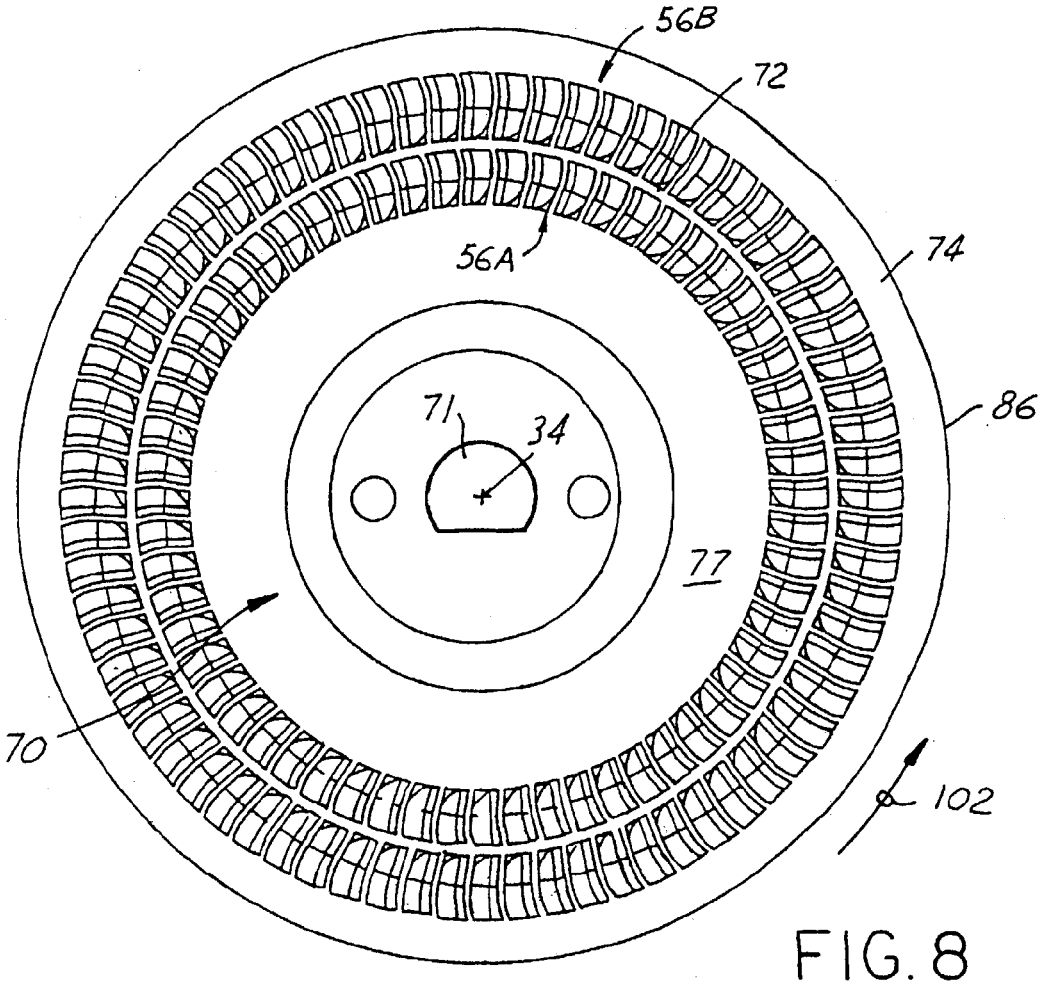
FIG. 8 is a top plan view of the impeller shown in FIG. 7.

The previous discussion of the turbine fuel pump assembly 30, as well as its many elements, was provided to demonstrate the types of fluid pumps with which the impeller of the present invention may be used. Accordingly, the impeller of the present invention could also be utilized by any one of a number of other turbine fluid pumps, as its application should not be limited to the exemplary fluid pump assembly 30 described herein and shown in the drawings. Turning to FIGS. 7 and 8, the impeller of the present invention will now be described in more detail.

The impeller 48 of the present invention rotates about the rotational axis 34 in a direction designated by arrow 102. Impeller 48 is a generally disc-shaped component having a top face 77 directly facing the bottom surface 59 of the upper casing, and a bottom face 79 directly facing the top surface 69 of the lower casing. To prevent or minimize fuel cross-flow between the inner and outer pumping chambers 54A, 54B and to prevent fuel leakage in general, the top face 77 is in a sealing relationship with the bottom surface 59, and the bottom face 79 is in a sealing relationship with the top surface 69. A circular hub 70 of the impeller 48 carries a key hole 71, through which the rotating shaft 35 extends such that the shaft and impeller co-rotate about axis 34. The hub 70 extends radially outward to the inner vane array 56A. A mid-hoop 72 is disposed radially between the inner and outer vane arrays 56A, 56B, and an outer hoop 74 is disposed radially outward from the outer vane array 56B. The hub 70 is defined on a radially outward circumferential perimeter by an outwardly facing surface 66A, which was previously discussed in connection with FIG. 2. It is from this surface, which is henceforth referred to as the outer hub surface 66A, that the plurality of vanes extend in a generally radial outward fashion.

Figure 9:
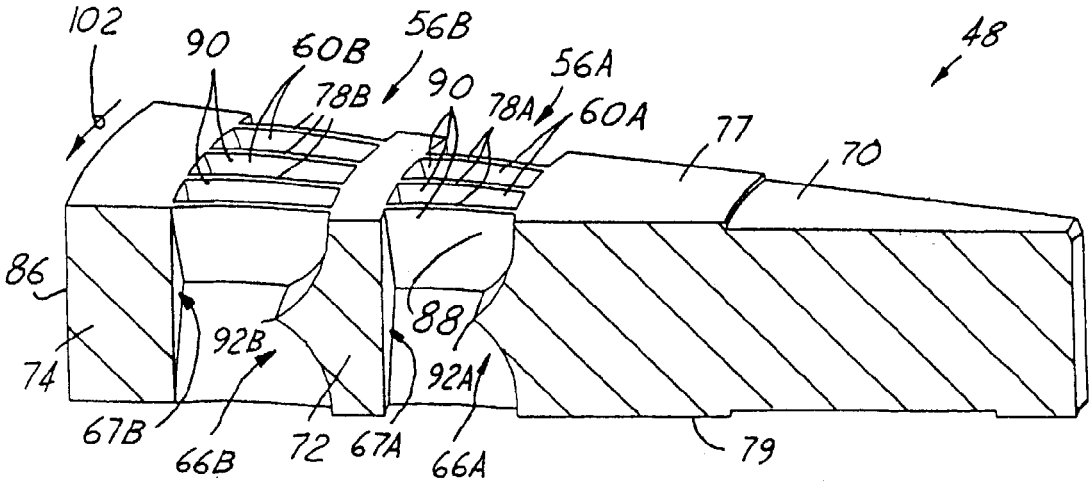
FIG. 9 is a perspective fragmentary view of the impeller shown in FIG. 7.

With reference now to FIG. 9, the inner vane array 56A includes numerous individual vanes 78A, each of which projects radially outward from outer hub surface 66A to the inward facing surface 67A, which was also discussed in conjunction with FIG. 2. For purposes of clarity, surface 67A will henceforth be referred to as the inner mid hoop surface 67A. The mid hoop 72 is defined radially between and carries inner mid hoop surface 67A, as well as an outward facing surface 66B, now referred to as outer mid hoop surface 66B. Each vane 78B of the outer vane array 56B projects radially outward from outer mid hoop surface 66B to the inward facing surface 67B. The outer hoop 74 is located on the outer periphery of the impeller and is defined radially between inner surface 67B and a peripheral edge 86 of the impeller. For clarification, surfaces 66A, 67A, 66B and 67B, as shown in FIG. 9, are the same as those shown in FIG. 2 that were previously discussed. The peripheral edge 86 directly opposes a downward projecting annular shoulder 87 of the upper casing 42, as best seen in FIG. 1. A distal annular surface of the shoulder 87 sealably engages the top surface 69 of the lower casing 44.

Each vane 78A of the inner vane array 56A and each vane 78B of the outer vane array 56B radially extends within the impeller 48 in a non-linear fashion, such that it increases the pumping efficiency of the impeller. The vanes will now be described in connection with several Figures, each of which shows the vanes from a different perspective and highlights different attributes of the vanes and/or the impeller.

Figure 10:
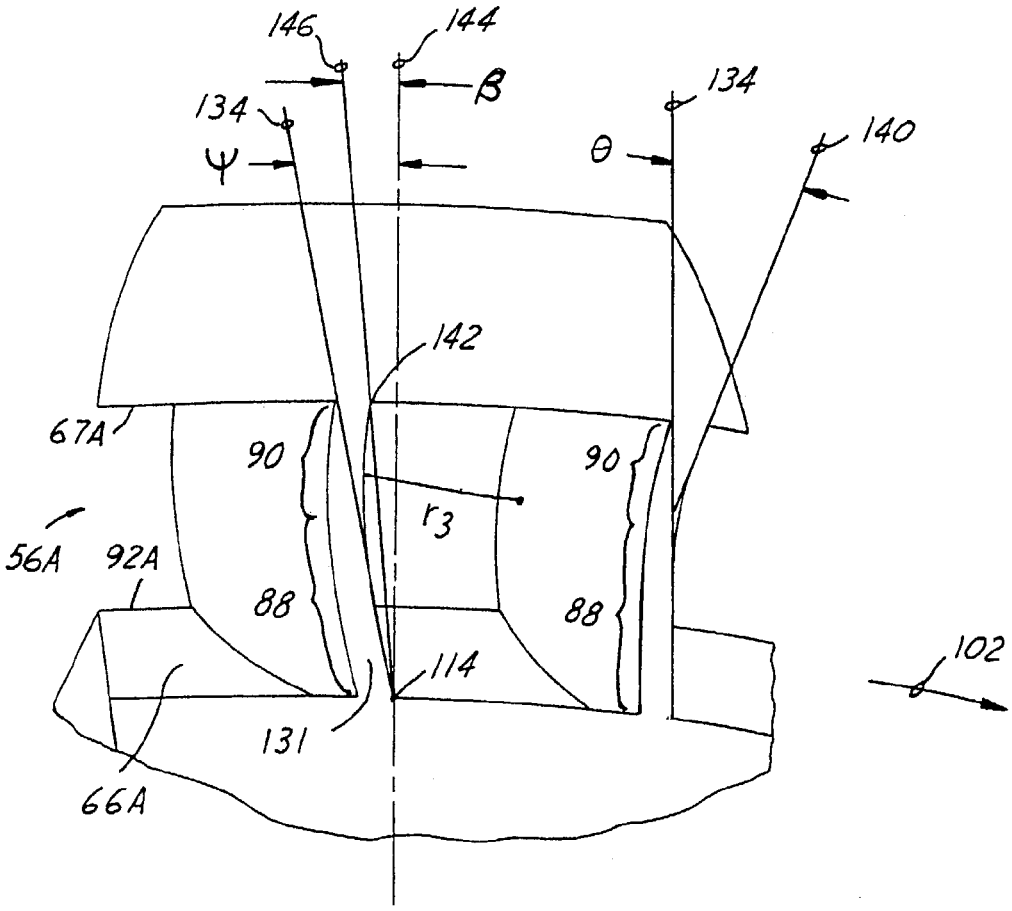
FIG. 10 is an enlarged, partial, bottom plan view of the impeller shown in FIG. 7.

Turning now to FIG. 10, there is shown an enlarged view of the inner vane array 56A, however, the following description applies equivalently to the outer vane array 56B, unless otherwise stated. Each vane includes a root segment 88 that radially projects in a substantially linear direction, as indicated by line 134, outwardly from outer hub surface 66A. The line 134, and hence linear root segment 88, extends in a slightly retarded or trailing direction, with respect to the impeller's radius 144 when considered in the direction of rotation 102. In this figure, line 134 lies along the leading face of the vane and thus passes through a point 114, however, this line could just as easily be drawn along the trailing side of the vane or through the middle of the vane, as long as it is parallel to the vane faces. Similarly, the impeller radius 144 is also drawn such that it passes through point 114. This trailing orientation of the linear root segment 88 forms an angle $\psi$, which is defined as the angle between line 134 and the radius 144 of the impeller; the radius of the impeller, of course, passes through the center of the impeller. The angle $\psi$ is preferably in the range of 2°–20°, even more preferably in the range of 5°–15°, and is most preferably about 10°. A tip segment 90 of each vane projects contiguously from the outer terminus or outermost radial portion of the root segment 88 to the inner mid hoop surface 67A. As shown in the drawings, tip segment 90 is slightly curved such that it is concaved with respect to the direction of rotation 102. That is, tip segment 90 is curved such that the linear root segment and the curved tip segment form a fuel catching pocket when impeller 48 is rotating in direction 102. Preferably, tip 90 has a uniform curve that is defined by an imaginary radius $r_3$ that has a length in the range of between 1.00 mm–5.00 mm, and more preferably in the range of 2.25 mm–3.25 mm for the inner vane array 56A, and in the range of 2.75 mm–3.75 mm for the outer vane array 56B. As the tip segment 90 projects substantially radially outward from the distal end of the root segment 88 (the distal end of the root segment being the most retarded or trailing radial position on the vane), it also projects in a slightly advanced direction with respect to the linear root segment, when considered in the direction of impeller rotation 102. This advanced alignment is shown in FIG. 10 as angle $\theta$, which represents the angular separation between the retarded line 134, which extends along the leading face of linear root segment 88, and the advanced line 140, which is tangential to a point on the leading face of the curved tip segment 90. Because the orientation of the tangential line 140 is dependent upon the particular point along the leading face of the tip segment with which it is tangential, the angle $\theta$ varies along the radial extent of the tip segment 90. Angle $\theta$ is in the range of 0°–50°, desirably 15°–35°, and preferably about 28° assuming line 140 is tangential to a point located at the radially outermost end of the tip segment (a point proximate to where the tip segment joins surface 67A). The advanced tip angle $\theta$ increases the pumping efficiency as a result of the fuel flow leaving the impeller 48 at a forward tangential velocity that is greater than the tangential speed of the impeller. Although not designated by a particular angle in the drawings, the advanced line 140 extends in a direction that is also advanced of the impeller radius 144, when considered in the rotational direction 102. As with angle $\theta$, this angle varies over the radial extent of the tip segment 90, depending upon the particular point along the leading surface of the curved tip segment from which the tangential line originates. For example, a line tangent to the radially innermost point on the tip segment 90 is oriented at a different angle than a line tangent to the radially outermost point on the tip segment. The range of angles between tangential line 140 and the impeller radius 144 is within the range of 0°–30°, is desirably between 10°–25°, and is preferably about 18° assuming line 140 is tangential to a point located at the radially outermost end of the tip segment. Furthermore, the root and tip segments preferably have equal radial lengths; stated differently, the radial distance from surface 66A to the end of the root segment 88 is approximately equal to the radial distance from the beginning of the tip segment 90 to surface 67A, in a preferred embodiment.

The advance in circumferential travel of the tip segment 90 is generally not as great as the retard in circumferential travel of the root segment 88. Therefore, the overall radial projection of the vanes between the outer hub surface 66A and the inner mid hoop surface 67A, is slightly retarded when considered in the direction of impeller rotation 102. In other words, the radially innermost point 114 on the leading surface of the vane is advanced when compared to the radially outermost point 142 on the leading surface the vane, when considered in the direction of rotation 102. This retarded or trailing alignment is demonstrated as angle β, which represents the angular separation between the impeller radius 144 and line 146, which connects points 114 and 142. It follows, that during rotation of the impeller, point 114 reaches a particular angular position before point 142. Angle β is in the range of 0°–10°, is desirably between 0°–5°, and is preferably about 2°.

Each of the grooves 58A, 58B and 62A, 62B and corresponding concave sections 73A, 73B and 75A, 75B together produce their own generally independent helical fuel flow pattern. However, the upper grooves 58A and 58B may still communicate with their respective lower grooves 62A and 62B via the open vane pockets defined between adjacent vanes. A single vane pocket 60A of the inner vane array is defined circumferentially between adjacent vanes 78A and radially between surfaces 66A and 67A. Likewise, a single vane pocket 60B of the outer vane array is defined circumferentially between adjacent vanes 78B and radially between surfaces 66B and 67B. The vane pockets 60A, 60B communicate laterally or axially outward with both the respective upper and lower grooves 58A, 58B and 62A, 62B. This open pocket configuration permits fuel flowing from the inlet passage 50 to flow through the lower grooves into the respective upper grooves; similarly, it allows fuel to exit from the lower grooves by flowing through the respective upper grooves and into the fuel outlet passage 52.

Figure 11:
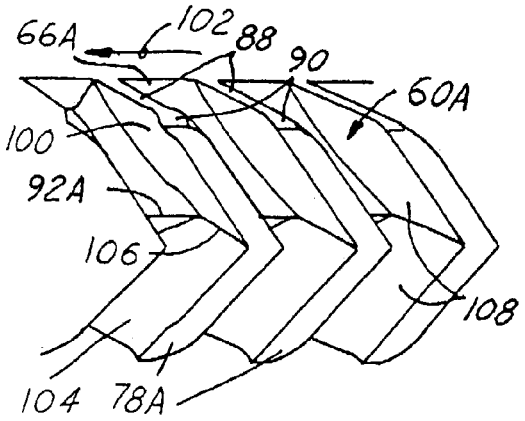
Figure 12:
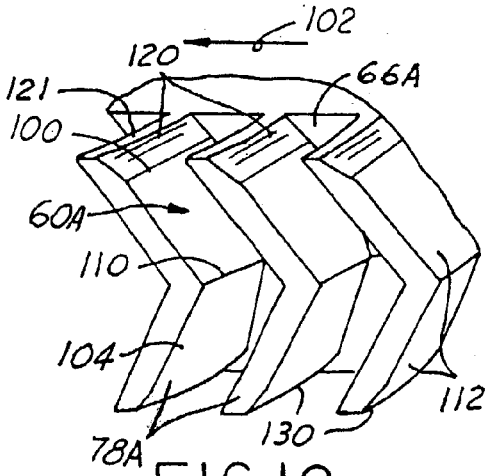
FIG. 12 is a partial perspective view of the impeller shown in FIG. 7 looking radially inward with portions removed to show internal detail of a trailing surface of the vanes.
Figure 13:
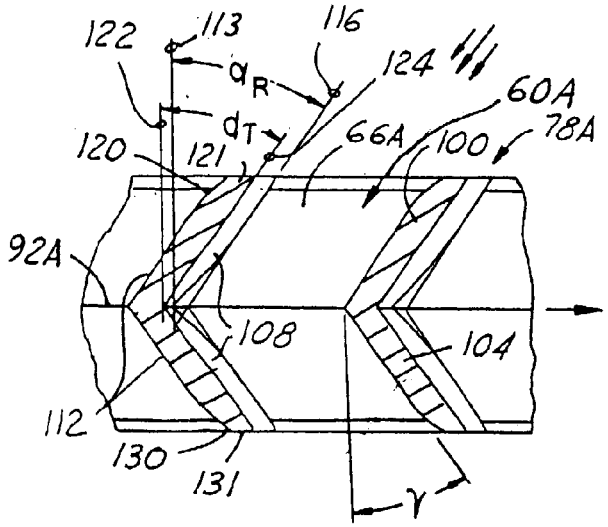
FIG. 13 is a partial cross sectional view of the impeller shown in FIG. 7 looking radially inward.
Figure 14:
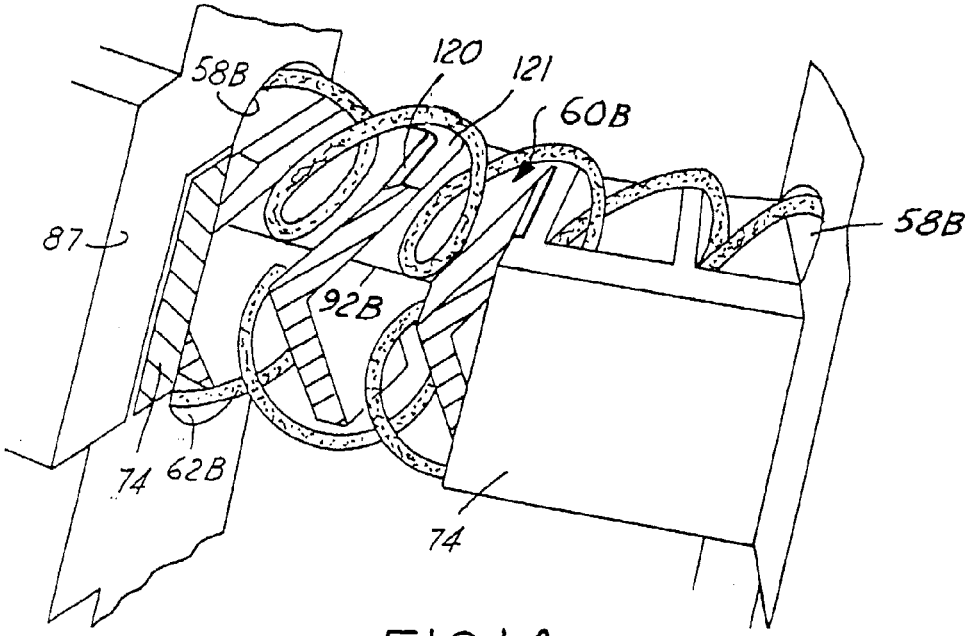
FIG. 14 is a partial perspective view of the pumping chambers and impeller with portions removed to illustrate the helical flow path of the fuel.

For the purposes of clarity and simplicity, the following paragraphs will only describe vanes of the inner vane array with the understanding that the vanes of the outer vane array are substantially identical unless otherwise stated. Referring now to FIGS. 11–13, but paying particular attention to FIG. 13, the imaginary plane wherein the ridge 92A lies, bisects the V-shaped vane 78A into an upper half 100 and a lower half 104 along a leading intersection line 106 on a leading surface 108 of the vane, and along a trailing intersection line 110 on a trailing surface 112 of the vane. The concave leading surface 108 of one vane faces the convex trailing surface 112 of an adjacent vane 78A. The upper half 100 and the lower half 104 of the vanes 78A are sloped or inclined forward in the direction of impeller rotation 102, that is, they generally extend from the imaginary plane carrying the ridge 92A, to the respective imaginary planes carrying the top and bottom faces 77, 79 of the impeller. The incline angle of the upper half 100 is a substantial mirror image of the incline angle of the lower half 104; that is, they are preferably symmetrical. That incline angle should be greater than 0° to increase pumping efficiency and low voltage flow. The forward incline of the vane allows for better entry of the fuel into the vane pocket 60A, thus producing the helical trajectory of fuel flow, as best shown in FIG. 14. In other words, the fuel rises in pressure as it flows within the pumping chambers 54A, 54B by the mechanical rotation of the impeller 48 and the vortex-like, helical flow characteristics of the fuel. The fuel flow pattern is induced by the respective circumferential vane arrays 56A and 56B which causes the fuel to flow repeatedly into and out of the grooves 58A, 58B and 62A, 62B.

During manufacturing of the impeller 48, the impeller must be released from the mold via a rotational motion. Therefore, the root segment 88 of the vane has an incline angle α(R) which is equal to, or preferably slightly less than (that is, flatter along in axial direction) an incline angle α(T) of the tip segment 90. The incline angles α(R) and α(T) can be measured from either the leading or the trailing sides of the vane, as they are parallel. Preferably, the incline angle α of the inner vane array gradually increases from the root segment 88 through the tip segments 90, and is in the range of 10°–50°, is desirably in the range of 20°–40°, and is preferably about 25° at the radially innermost point of the root segment and is preferably 35° at the radially outermost point of the tip segment. An equivalent relationship exists for the vanes of the outer array, however, their incline angle is in the range of 15°–55°, is desirably between 20°–45°, and is preferably about 30° at the radially innermost point of the root segment and 40° at the radially outermost point of the tip segment. Accordingly, the following relationship between the incline angle at the root versus that angle at the tip holds true for both the inner and outer vane array: $10° \leqq \alpha(R) \leqq \alpha(T) \leqq 55°$. The incline angle α(R) of the root segment is measured in degrees between a vertical or axial reference line 113, which is parallel to the rotating axis 34, and an incline line 116 which lies along a leading surface of vane 78A at the root segment 88. As previously stated, each of the vane upper and lower halves 100, 104 have leading and trailing surfaces 108, 112 that are parallel; that is, the vane has a uniform vane thickness in the circumferential direction. Thus, incline line 116 could alternatively be located along the trialing vane surface as well. Reference line 113 and incline line 116 preferably intersect each other at a point that lies on the leading face of the vane and on the radius of the impeller 144 (not shown in FIGS. 11–13). Separately, the radially innermost ends of the leading intersection line 106 and the trailing intersection line 110 are contiguous to the ridge 92A, as best shown in FIGS. 11 and 12.

The incline angle α(T) of the tip is measured in degrees between a vertical or axial reference line 122, which is parallel to both the rotating axis 34 and the reference line 113, and an incline line 124, which preferably lies along the leading surface 108 of the vane in the region of the tip segment 90. As previously explained, incline line 113 could lie along the trailing vane surface 112 as well.

Also, the incline angles α(R) and α(T) of the vanes of the inner vane array 56A are respectively less than those of the vanes of the outer vane array 56B. Amongst other benefits, this difference in angles allows the impeller to be rotated out of a single rotational mold during manufacturing. This incline angle arrangement does not sacrifice pump performance, since the vanes of the inner vane array 56A operate with a higher pressure coefficient and thus require a smaller incline angle α for optimum performance than do the vanes of the outer vane array 56B.

As previously discussed, the root segment 88 radially extends outward from the outer hub surface 66A in a retarded or trailing manner, with respect to the radius of the impeller 144. It follows, that the leading intersection line 106, which separates the upper and lower halves 100, 104 of the vane, includes a radially inward portion that also extends in a retarded or trailing manner, with respect to radius 144 when considered in direction 102. This radially inward portion of the leading intersection line 106 is the portion that linearly extends from the ridge 92A to the radially outer terminus of the root segment. Leading intersection line 106 also includes a radially outward portion that extends in an advanced, curvilinear direction, just like the tip segment 90. This radially outward portion is the portion of the leading intersection line 106 that begins where the radially inward portion left off, and extends outward to the inner mid hoop surface 67A. Stated differently, the leading intersection line 106 includes a radially inward portion that is part of the root segment 88 and thus extends in a retarded, linear direction, and a radially outward portion that is part of the tip segment 90 and thus extends in an advanced, curved direction. As previously indicated this pocket forming or cupped vane configuration, when considered in both the radial and the axial directions, enhances pumping efficiency.

As shown in FIG. 13 and as previously mentioned, each half 100, 104 of each vane 78A also has a back angle $\gamma$ which is preferably equal to the opposite front incline angles $\alpha(R)$ and $\alpha(T)$. This results in a uniform vane thickness when considered in a circumferential direction, and eases the manufacturing process by allowing for the release of the impeller following the molding process. It is possible, however, for the back angle $\gamma$ to be greater than the corresponding front incline angle ("corresponding" means the portion of the front surface 108 that is at the same radial position on the vane), which would result in vanes having front and rear surfaces that converge together as they approach the axial side walls or ends of the vane. Consequently, because the minimum value of $\alpha(R)$ is 10° and because $\alpha(T)$ is equal to or greater than $\alpha(R)$, then the minimum value of $\gamma$, along the entire radial extent of the vane, is also 10°.

Each vane also includes two radii 120, 130 formed along edges located between the trailing vane surface 112 and adjacent upper and lower side walls 121, 131. Sidewall 131, best seen in FIG. 10, is the fingerlike surface of the vane which generally lies in the same plane as the bottom face of the impeller, and opposes the top surface 69 of the lower casing. Similarly, sidewall 121, which is not shown in FIG. 10, is the complimentary fingerlike surface of the vane that is located on the opposite axial side of the impeller, and thus, generally lies in the same plane as the top face 77 of the impeller such that it opposes the bottom surface 59 of the upper casing. Radius 120 is a uniform rounded surface that extends the entire radial length of the vane, and therefore includes a portion that is part of the root segment 88 and a portion that is part of the tip segment 90. Constructing the radius such that it is a rounded surface with a particular radius (0.70 mm in the preferred embodiment) helps align the trailing surface of the vane with the incoming fuel stream, thereby increasing the efficiency of the pump by reducing cavitation and the creation of unwanted vapors. Both the back angle $\gamma$ and the radius 120 are selected such that they are aligned as best as possible with an incoming fuel stream (shown as arrows in FIG. 13) as it enters the vane pocket 60A. Experimentation has shown that the use of a rounded radius on the impeller of the present invention is preferable over the use of a flat chamfer, as is sometimes used in the art.

Figure 15:
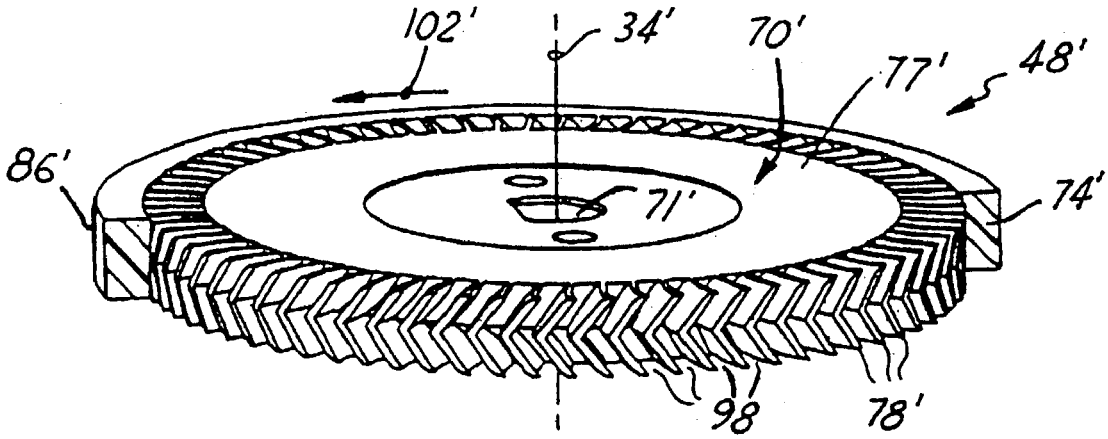
FIG. 15 is a perspective view of a second embodiment of the impeller of the present invention having only a single vane array, with portions removed to show internal detail.
Figure 16:
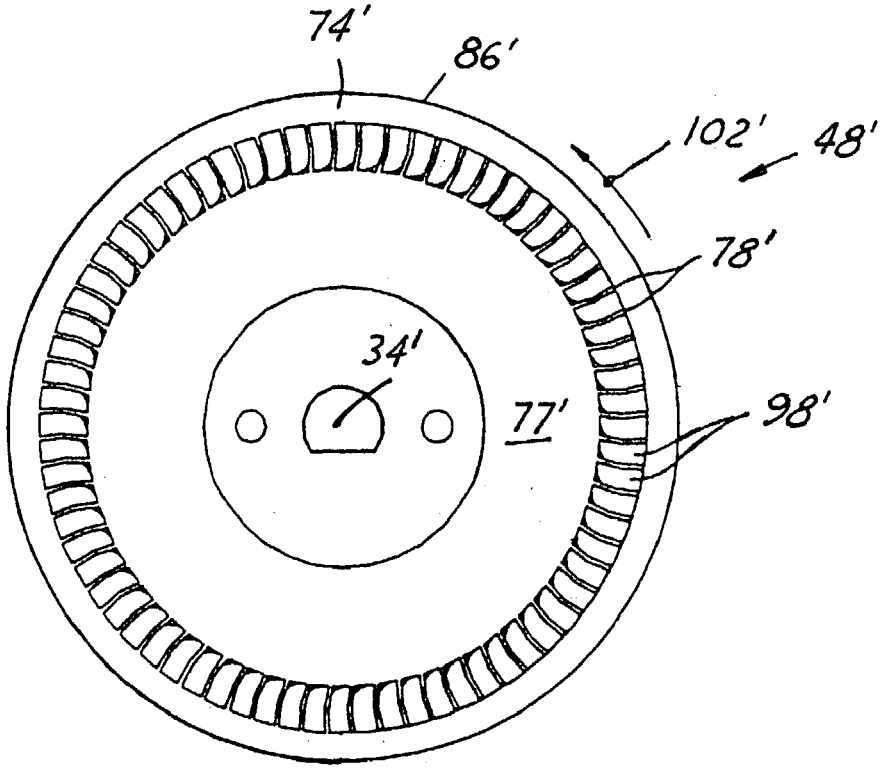
FIG. 16 is a top plan view of the impeller shown in FIG. 15.

Of course, the previous explanation of impeller components, particularly the linear root segment, curved tip segment, circumferential ridge, vane pockets, upper vane half, lower vane half, leading intersection line, trailing intersection line, and radius, as well as all angles, reference lines, imaginary planes, etc. pertaining thereto, apply equally to the outer vane array 56B, unless stated otherwise. Moreover, the previous discussion is not limited to a dual vane array impeller, and could equally apply to a vane impeller having one, three, four, or any other number of vane arrays that may practicably be utilized by the impeller. An example of an embodiment of the impeller of the present invention having only a single vane array is seen in FIGS. 15 and 16, wherein like numerals designate like components.

In operation, impeller rotation causes fuel to flow into the pumping section 32 through the common fuel inlet passage 50, which is carried by the lower casing 44 and communicates with the lower grooves 62A, 62B. The fuel rises in pressure as it is propelled in what is a vortex-like fuel flow pattern within the independent pumping chambers 54A, 54B by the mechanical rotation of the impeller 48. The vortex-like fuel flow pattern is induced by the inner and outer circumferential vane arrays 56A, 56B, which act upon the fuel independently from one-another as best illustrated in FIG. 14. Once the fuel reaches the circumferential end of the pumping chambers, the pressurized fuel exits pumping section 32 through the fuel outlet passage 52, which is in fluid communication with the upper grooves 58A, 58B (not shown). If mounted in a vehicle, outlet 52 would then provide the pressurized fuel to some type of conduit or other component of a vehicle fuel delivery system, from which, the fuel would be supplied to an internal combustion engine.

Figure 17:
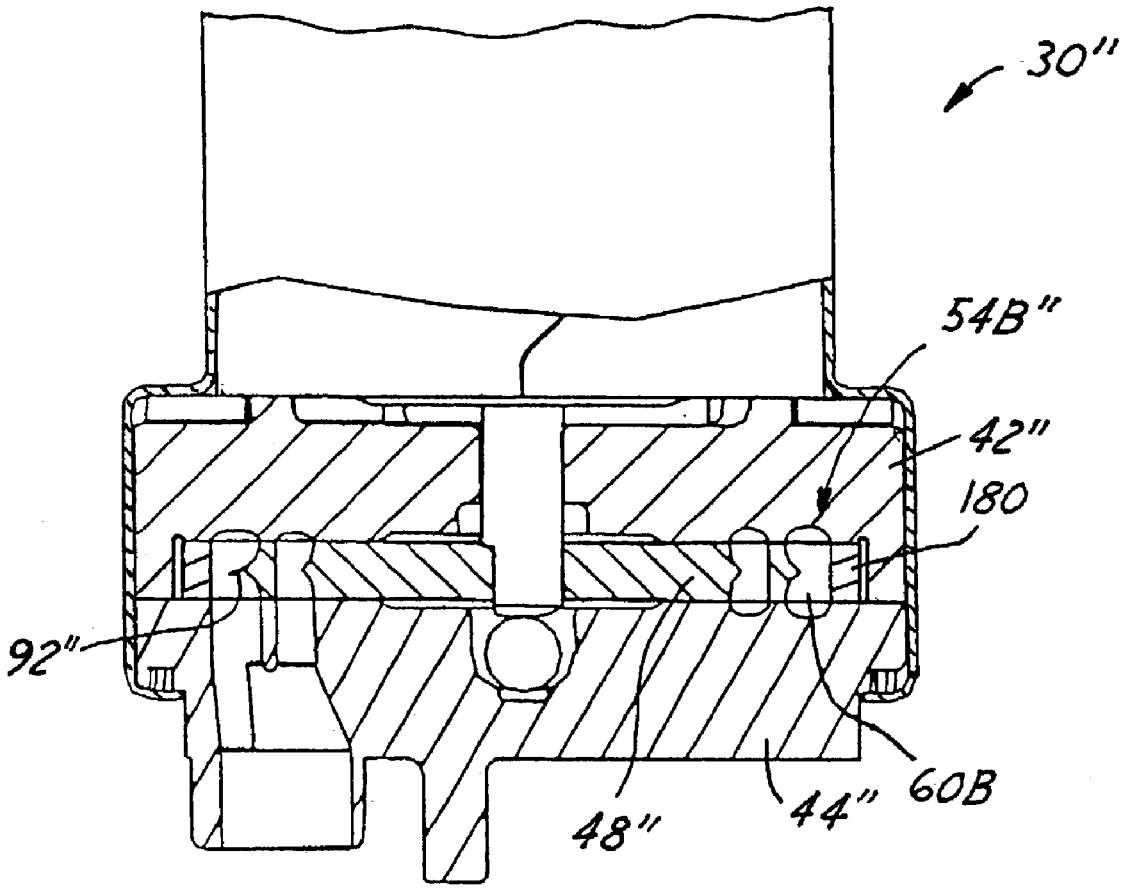
FIG. 17 is a partial cross-sectional view of an example of a turbine fuel pump assembly that may utilize a third embodiment of the impeller of the present invention.

Accordingly to the alternative embodiment shown in FIG. 17, a turbine fuel pump assembly 30" is illustrated where the outer hoop of the impeller of the previous embodiment has been removed and replaced with a stationary guide ring 180, as is known per se in the art. The stationary guide ring 180 is not an integral portion of the impeller and accordingly does not rotate with the impeller. Stationary guide ring 180 includes a stripper portion (not shown) that shears the fuel off of the open ends or tips of the vanes of an outer circumferential vane array. In other words, an outer annular pumping chamber 54B" is disposed along the outer most periphery of the impeller such that the outer most vane pockets 60B" communicate in both the axial direction and in the radial direction. This type of arrangement per se is known in the art, and is sometimes referred to as Peripheral Vane Technology (PVT).

It will thus be apparent that there has been provided in accordance with the present invention a fluid pump impeller which achieves the aims and advantages specified herein. It will, of course, be understood that the foregoing description is of preferred exemplary embodiments of the invention and that the invention is not limited to the specific embodiments shown. Various changes and modifications will become apparent to those skilled in the art and all such changes and modifications are intended to be within the scope of the present invention.

What is claimed is:

1. A turbine fuel pump impeller, comprising:

a circular hub having an outer hub surface generally extending around its outer circumference;

a ring-shaped hoop having an inner hoop surface generally extending around its inner circumference, and a ring-shaped vane array being arranged such that said hub, hoop and vane array are all generally concentric, with said vane array being located at a radial position between said hub and said hoop, said vane array having a plurality of vanes and a plurality of vane pockets that are generally formed in between said vanes, wherein each of said plurality of vanes includes:

i) a linear root segment extending away from said outer hub surface in a first direction, and ii) a curved tip segment extending away from an outer terminus of said root segment in a generally continuously curved manner towards said inner hoop surface to form a fuel catching pocket such that a line tangent to a point on said curved tip segment extends in a second direction, where said first direction is retarded with respect to said second direction (angle θ) when considered in the rotational direction of said impeller.

2. The turbine fuel pump impeller of claim 1, wherein said angle θ is in the range of 0°–50°, assuming said line tangent to said curved tip segment is tangent to a point located anywhere on said curved tip segment leading surface.

3. The turbine fuel pump impeller of claim 2, wherein said angle θ is in the range of 15°–35°, assuming said line tangent to said curved tip segment is tangent to a point located at a radially outermost point on said curved tip segment.

4. The turbine fuel pump impeller of claim 1, wherein said first direction is also retarded with respect to the radius of the impeller (angle ψ) by a certain number of degrees, when considered in the rotational direction of said impeller.

5. The turbine fuel pump impeller of claim 4, wherein said angle ψ is in the range of 2°–20°.

6. The turbine fuel pump impeller of claim 5, wherein said angle ψ is in the range of 5°–15°.

7. The turbine fuel pump impeller of claim 1, wherein said second direction is also advanced with respect to the radius of the impeller by a certain number of degrees, when considered in the rotational direction of said impeller.

8. The turbine fuel pump impeller of claim 7, wherein said certain number of degrees is in the range of 0°–30°, assuming said line tangent to said curved tip segment is tangent to a point located anywhere on said curved tip segment leading surface.

9. The turbine fuel pump impeller of claim 8, wherein said certain number of degrees is in the range of 10°–25°, assuming said line tangent to said curved tip segment is tangent to a point located at a radially outermost point on said curved tip segment.

10. The turbine fuel pump impeller of claim 1, wherein the point at which the leading surface of said tip segment joins said inner hoop surface trails the point at which the leading surface of said root segment joins said outer hub surface by a certain number of degrees (angle β), when considered in the rotational direction of said impeller.

11. The turbine fuel pump impeller of claim 10, wherein said angle β is in the range of 0°–10°.

12. The turbine fuel pump impeller of claim 11, wherein said angle β is in the range of 0°–5°.

13. A turbine fluid pump impeller, comprising:

a circular hub having an outer hub surface generally extending around its outer circumference;

a ring-shaped hoop having an inner hoop surface generally extending around its inner circumference, and a ring-shaped vane array being arranged such that said hub, hoop and vane array are all generally concentric, with said vane array being located at a radial position between said hub and said hoop, said vane array having a plurality of vanes and a plurality of vane pockets that are generally formed in between said vanes, wherein each of said plurality of vanes includes:

i) a linear root segment extending away from said outer hub surface in a first direction, and ii) a curved tip segment extending away from an outer terminus of said root segment and towards said inner hoop surface such that a line tangent to said curved tip segment extends in a second direction, where said first direction is retarded with respect to said second direction (angle θ) when considered in the rotational direction of said impeller, wherein said outer hub surface includes a generally circumferentially extending ridge and said inner hoop surface is generally flat.

14. The turbine fluid pump impeller of claim 13, wherein said ridge radially extends only a partial distance towards said inner hoop surface, such that they do not contact each other.

15. The turbine fluid pump impeller of claim 14, wherein said ridge forms upper and lower concaved sections in each of said vane pockets that interact with an upper groove formed in an upper casing and a lower groove formed in a lower casing, respectively.

16. The turbine fluid pump impeller of claim 15, wherein said upper and lower grooves each has a cross-sectional shape that includes first and second radial sections that are semi-circular and are connected together via a flat section.

17. The turbine fuel pump impeller of claim 1, wherein said curved tip segment is at least partially defined by a radius having a length in the range of 1.00 mm–5.00 mm.

18. The turbine fuel pump impeller of claim 17, wherein said radius is approximately 3.00 mm.

19. The turbine fuel pump impeller of claim 1, wherein each of said plurality of vanes includes an upper half and a lower half generally arranged in a V-shape configuration that opens in the rotational direction of said impeller.

20. The turbine fuel pump impeller of claim 19, wherein said V-shape configuration of each of said halves is measured by an incline angle α, with respect to an axially extending reference line, and wherein said incline angle at said root segment α(R) is < said incline angle at said tip segment α(T).

21. The turbine fuel pump impeller of claim 20, wherein said incline angle at any point along said root segment α(R) is in the range of 10°–50°.

22. The turbine fuel pump impeller of claim 21, wherein said incline angle at a radially innermost point of said root segment α(R) is in the range of 20°–30°.

23. The turbine fuel pump impeller of claim 20, wherein said incline angle at any point of said tip segment α(T) is in the range of 10°–50°.

24. The turbine fuel pump impeller of claim 23, wherein said incline angle at a radially outermost point of said tip segment α(T) is in the range of 30°–40°.

25. The turbine fuel pump impeller of claim 19, wherein said upper and lower halves are symmetrical about an imaginary plane that is normal to the impeller axis of rotation and that bisects each of said vanes in half.

26. The turbine fuel pump impeller of claim 25, wherein said imaginary plane bisects each of said vanes along both a leading intersection line and a trailing intersection line, each of which includes a radially inward root segment that extends in a linear direction and a radially outward tip segment that extends in a curved direction.

27. The turbine fuel pump impeller of claim 1, wherein each of said plurality of vanes has a uniform vane thickness between leading and trailing vane surfaces, when considered in the circumferential direction.

28. The turbine fuel pump impeller of claim 1, wherein each of said plurality of vanes includes a sidewall surface, a trailing vane surface and a rounded radius located there between.

29. The turbine fluid fuel impeller, of claim 28, wherein said rounded radius is uniform along its radial extent, and radially extends from said outer hub surface to said inner hoop surface.

30. The turbine fuel pump impeller of claim 29, wherein said rounded surface is at least partially defined by a radius in the range of 0.10 mm–1.50 mm.

31. The turbine fuel pump impeller of claim 30, wherein said radius is approximately 0.70 mm.

32. The turbine fuel pump impeller of claim 1, wherein said ring-shaped hoop is a mid hoop of a multiple-array impeller.

33. The turbine fuel pump impeller of claim 1, wherein said impeller is a multiple-array impeller having a plurality of ring-shaped hoops and a plurality of ring-shaped vane arrays.

34. The turbine fuel pump impeller of claim 33, wherein the vanes of an inner vane array have a V-shaped configuration generally defined by a first incline angle α, the vanes of an outer vane array have a V-shaped configuration generally defined by a second incline angle α, and wherein said first incline angle is smaller than said second incline angle.

35. The turbine fuel pump impeller of claim 1, wherein said fuel pump impeller is for use with a vehicle fuel delivery system.

36. A turbine fluid pump impeller, comprising:

a circular hub having an outer hub surface with a ridge, said outer hub surface and said ridge both generally extend around an outer circumference of said hub;

a ring-shaped hoop having an inner hoop surface that is generally flat and extends around an inner circumference of said hoop; and a ring-shaped vane array being arranged such that said hub, hoop and vane array are all generally concentric with said vane array being located at a radial position between said hub and said hoop, said vane array having a plurality of vanes and a plurality of vane pockets that are generally formed in between said vanes, wherein each of said plurality of vanes includes:

i) an upper half and a lower half generally arranged in a V-shape configuration that opens in the rotational direction of said impeller, ii) a root segment extending away from said outer hub surface in a first general direction, and iii) a tip segment extending away from an outer terminus of said root segment and towards said inner hoop surface generally in a second direction, wherein said first direction is retarded with respect to said second direction such that the point at which a leading surface of said tip segment joins said inner hoop surface trails the point at which a leading surface of said root segment joins said outer hub surface (angle β), when considered in the rotational direction of said impeller.

37. The turbine fluid pump impeller of claim 36, wherein said first direction is also retarded with respect to the radius of the impeller (angle ψ) by a certain number of degrees, when considered in the rotational direction of said impeller.

38. The turbine fluid pump impeller of claim 37, wherein said angle ψ is in the range of 2°–20°.

39. The turbine fluid pump impeller of claim 38, wherein said angle ψ is in the range of 5°–15°.

40. The turbine fluid pump impeller of claim 36, wherein said second direction is defined by a line tangent to a point on said tip segment, said second direction being advanced with respect to the radius of the impeller by a certain number of degrees, when considered in the rotational direction of said impeller.

41. The turbine fluid pump impeller of claim 40, wherein said certain number of degrees is in the range of 0°–30°, assuming said line tangent to said tip segment is tangent to a point located anywhere on said tip segment leading surface.

42. The turbine fluid pump impeller of claim 41, wherein said certain number of degrees is in the range of 10°–25°, assuming said line tangent to said tip segment is tangent to a point located at a radially outermost point on said tip segment.

43. The turbine fluid pump impeller of claim 36, wherein said angle β is in the range of 0°–10°.

44. The turbine fluid pump impeller of claim 43, wherein said angle β is in the range of 0°–5°.

45. The turbine fluid pump impeller of claim 36, wherein said ridge radially extends only a partial distance towards said inner hoop surface, such that they do not contact each other.

46. The turbine fluid pump impeller of claim 45, wherein said ridge forms upper and lower concaved sections in each of said vane pockets that interact with an upper groove formed in an upper casing and a lower groove formed in a lower casing, respectively.

47. The turbine fluid pump impeller of claim 46, wherein said upper and lower grooves each has a cross-sectional shape that includes first and second radial sections that are semi-circular and are connected together via a flat segment.

48. The turbine fluid pump impeller of claim 36, wherein said tip segment is curved such that it opens in the rotational direction of the impeller.

49. The turbine fluid pump impeller of claim 48, wherein said curved tip segment is at least partially defined by a radius having a length in the range of 1.00 mm–5.00 mm.

50. The turbine fluid pump impeller of claim 49, wherein said radius is approximately 3.00 mm.

51. The turbine fluid pump impeller of claim 36, wherein said V-shape configuration of each of said halves is measured by an incline angle α, with respect to an axially extending reference line, and wherein said incline angle at said root segment α(R) is < said incline angle at said tip segment α(T).

52. The turbine fluid pump impeller of claim 51, wherein said incline angle at any point along said root segment α(R) is in the range of 10°–50°.

53. The turbine fluid pump impeller of claim 52, wherein said incline angle at a radially innermost point of said root segment α(R) is in the range of 20°–30°.

54. The turbine fluid pump impeller of claim 51, wherein said incline angle at any point of tip segment α(T) is in the range of 10°–50°.

55. The turbine fluid pump impeller of claim 54, wherein said incline angle at a radially outermost point of said tip segment α(T) is in the range of 30°–40°.

56. The turbine fluid pump impeller of claim 36, wherein said upper and lower halves are symmetrical about an imaginary plane that is normal to the impeller axis of rotation and that bisects each of said vanes in half.

57. The turbine fluid pump impeller of claim 56, wherein said imaginary plane bisects each of said vanes along both a leading intersection line and a trailing intersection line, each of which includes a radially inward root segment that extends in a linear direction and a radially outward tip segment that extends in a curved direction.

58. The turbine fluid pump impeller of claim 36, wherein each of said plurality of vanes has a uniform vane thickness between leading and trailing vane surfaces, when considered in the circumferential direction.

59. The turbine fluid pump impeller of claim 36, wherein each of said plurality of vanes includes a sidewall surface, a trailing vane surface and a rounded radius located there between.

60. The turbine fluid pump impeller of claim 59, wherein said rounded radius is uniform along its radial extent, and radially extends from said outer hub surface to said inner hoop surface.

61. The turbine fluid pump impeller of claim 60, wherein said rounded surface is at least partially defined by a radius in the range of 0.10 mm–1.50 mm.

62. The turbine fluid pump impeller of claim 61, wherein said radius is approximately 0.70 mm.

63. The turbine fluid pump impeller of claim 36, wherein said impeller is a multiple-array impeller having a plurality of ring-shaped hoops and a plurality of ring-shaped vane arrays.

64. The turbine fluid pump impeller of claim 63, wherein the vanes of an inner vane array have a V-shaped configuration generally defined by a first incline angle $\alpha$, the vanes of an outer vane array have a V-shaped configuration generally defined by a second incline angle $\alpha$, and wherein said first incline, angle is smaller than said second incline angle.

65. The turbine fluid pump impeller of claim 36, wherein said fluid pump is a fuel pump for use with a vehicle fuel delivery system.

66. A single-stage, multiple-array fluid pump impeller, comprising:

a circular hub having an outer hub surface with a ridge, said outer hub surface and said ridge both generally extend around an outer circumference of said hub;

a ring-shaped inner vane array having a plurality of inner vanes and a plurality of inner vane pockets that are generally formed in between said inner vanes;

a ring-shaped mid hoop having an inner hoop surface and an outer hoop surface with a ridge, said inner hoop surface is generally flat and extends around an inner circumference of said mid hoop, and said outer hoop surface and ridge both generally extend around an outer circumference of said mid hoop;

a ring-shaped outer vane array having a plurality of outer vanes and a plurality of outer vane pockets that are generally formed in between said outer vanes; and a ring-shaped outer hoop having an inner hoop surface that is generally flat and extends around an inner circumference of said outer hoop, wherein said hub, inner vane array, mid hoop, outer vane array and outer hoop are all generally concentric, with said inner vane array being located at a radial position between said hub and said mid hoop and said outer vane array being located at a radial position between said mid hoop and said outer hoop, and wherein said hub ridge radially extends a partial distance into said inner vane pockets thus forming upper and lower inner vane pocket portions and said mid hoop ridge radially extends a partial distance into said outer vane pockets thus forming upper and lower outer vane pocket portions, such that fluid within one of said inner or outer vane pockets may communicate between said upper and lower vane pocket portions without leaving that vane pocket.

67. The fluid pump impeller of claim 66, wherein said hub ridge and said mid hoop ridge form upper and lower concaved sections in each of said vane pockets of said inner and outer vane arrays, respectively, such that:

i) said upper concaved section of said inner vane array interacts with an inner groove formed in an upper casing;

ii) said upper concaved section of said outer vane array interacts with an outer groove formed in the upper casing;

iii) said lower concaved section of said inner vane array interacts with an inner groove formed in a lower casing; and iv) said lower concaved section of said outer vane array interacts with an outer groove formed in the lower casing.

68. The fluid pump impeller of claim 67, wherein said inner and outer grooves of both the upper and lower casings each has a cross-sectional shape that includes first and second radial sections that are semi-circular and are connected together via a flat section.

69. The fluid pump impeller of claim 66, wherein the combined cross-sectional surface area of said upper and lower inner grooves is < the combined cross-sectional surface area of said upper and lower outer grooves.

70. The turbine fluid pump impeller of claim 66, wherein said fluid pump is a fuel pump for use with a vehicle fuel delivery system.

71. A turbine fuel pump assembly for use with a vehicle fuel delivery system, comprising:

a lower casing having a fuel inlet passage and a top surface;

an upper casing having a fuel outlet passage and a bottom surface;

an impeller cavity formed between said top and bottom surfaces and being in fluid communication with said fuel inlet and outlet passages;

an electric motor having a rotating shaft;

an impeller operably coupled to said shaft such that rotation of said shaft causes said impeller to rotate within said impeller cavity, said impeller comprising:

a circular hub having an outer hub surface generally extending around its outer circumference;

a ring-shaped hoop having an inner hoop surface generally extending around its inner circumference, and a ring-shaped vane array being arranged such that said hub, hoop and vane array are all generally concentric with said vane array being located at a radial position between said hub and said hoop, said vane array having a plurality of vanes and a plurality of vane pockets that are generally formed in between said vanes, wherein each of said plurality of vanes includes:

i) a linear root segment extending away from said outer hub surface in a first direction, and ii) a curved tip segment extending away from an outer terminus of said root segment and towards said inner hoop surface such that a line tangent to said curved tip segment extends in a second direction, where said first direction is retarded with respect to said second direction (angle $\theta$) when considered in the rotational direction of said impeller.

72. A generally disk-shaped turbine fuel pump impeller, comprising:

a circular hub having an outer hub surface with a ridge, said outer hub surface and said ridge both generally extend around an outer circumference of said hub;

a ring-shaped hoop having an inner hoop surface that is generally flat and extends around an inner circumference of said hoop; and a ring-shaped vane array being arranged such that said hub, hoop and vane array are all generally concentric with said vane array being located at a radial position between said hub and said hoop, said vane array having a plurality of vanes and a plurality of vane pockets that are generally formed in between said vanes, wherein each of said plurality of vanes includes:

i) a root segment extending away from said outer hub surface in a first general direction, and ii) a tip segment extending away from an outer terminus of said root segment and towards said inner hoop surface in a second general direction, where said first general direction is retarded with respect to said second general direction (angle θ) when considered in the rotational direction of said impeller, and top and bottom circular faces being generally parallel to each other, wherein said hub, hoop and vane array are located between said top and bottom circular faces such that each of said plurality of vane pockets is open to both said top and bottom circular faces.

* * * * *